US008780010B2

(12) United States Patent
Sanada

(10) Patent No.: US 8,780,010 B2
(45) Date of Patent: Jul. 15, 2014

(54) METAMATERIAL PROVIDED WITH AT LEAST ONE SPIRAL CONDUCTOR FOR PROPAGATING ELECTROMAGNETIC WAVE

(75) Inventor: Atsushi Sanada, Ube (JP)

(73) Assignee: Semiconductor Technology Academic Research Center, Kanagawa (JP)

( * ) Notice: Subject to any disclaimer, the term of this patent is extended or adjusted under 35 U.S.C. 154(b) by 350 days.

(21) Appl. No.: 13/221,201

(22) Filed: Aug. 30, 2011

(65) Prior Publication Data

US 2012/0212395 A1 Aug. 23, 2012

(30) Foreign Application Priority Data

Feb. 23, 2011 (JP) ..... 2011-037115

(51) Int. Cl.
*H01Q 1/36* (2006.01)

(52) U.S. Cl.
USPC ..... 343/895; 343/912; 343/909

(58) Field of Classification Search
CPC combination set(s) only.
See application file for complete search history.

(56) References Cited

U.S. PATENT DOCUMENTS

| | | | | |
|---|---|---|---|---|
| 6,608,811 | B1 | 8/2003 | Holden et al. | |
| 6,992,630 | B2 * | 1/2006 | Parsche | 343/700 MS |
| 7,205,941 | B2 * | 4/2007 | Wang et al. | 343/700 MS |
| 7,538,946 | B2 * | 5/2009 | Smith et al. | 359/569 |
| 2001/0038325 | A1 * | 11/2001 | Smith et al. | 333/202 |
| 2006/0125681 | A1 * | 6/2006 | Smith et al. | 342/120 |
| 2010/0007436 | A1 | 1/2010 | Sanada | |
| 2010/0118412 | A1 | 5/2010 | Sanada | |
| 2011/0175795 | A1 * | 7/2011 | Toujo | 343/909 |
| 2011/0287218 | A1 * | 11/2011 | Narimanov | 428/141 |
| 2011/0317275 | A1 * | 12/2011 | Smith et al. | 359/652 |
| 2012/0038219 | A1 * | 2/2012 | Wang et al. | 307/104 |
| 2012/0086463 | A1 * | 4/2012 | Boybay et al. | 324/612 |
| 2012/0193996 | A1 * | 8/2012 | Ryu et al. | 307/104 |
| 2013/0009851 | A1 * | 1/2013 | Danesh | 343/904 |

FOREIGN PATENT DOCUMENTS

| | | |
|---|---|---|
| JP | 2002-534883 | 10/2002 |
| JP | 2008-28010 | 2/2008 |
| JP | 2008-244683 | 10/2008 |
| JP | 2008-252293 | 10/2008 |
| WO | 2008/038542 | 4/2008 |

OTHER PUBLICATIONS

Leila Yousefi, "Artificail Magnetic Materials Using Fractal Hilbert Curves", IEEE, vol. 58, No. 8, Aug. 2010, pp. 2614-2622, 9 pages.*

(Continued)

*Primary Examiner* — Trinh Dinh
(74) *Attorney, Agent, or Firm* — Wenderoth, Lind & Ponack, LLP

(57) ABSTRACT

A metamaterial including at least one spiral conductor. Only a magnetic permeability selected from among an effective dielectric constant and the magnetic permeability of the metamaterial becomes negative, so that the metamaterial have a negative refractive index characteristic. The material includes a plurality of unit cells arrayed in one of one-dimensional direction, two-dimensional directions, and three-dimensional directions. Each of the unit cells includes a dielectric substrate having first and second surfaces disposed in a substantially parallel relationship, and first and second spiral conductors. The first spiral conductor is formed on the first surface of the dielectric substrate, and the second spiral conductor is formed in one of a same direction as and an opposite direction to the first spiral conductor, on the second surface of the dielectric substrate, to oppose the first spiral conductor and to be electromagnetically coupled with the first spiral conductor.

3 Claims, 8 Drawing Sheets

(56) References Cited

OTHER PUBLICATIONS

J.B. Pendry, "*Negative Refraction Makes a Perfect Lens*", Physical Review Letters, vol. 85, No. 18, pp. 3966-3969, Oct. 2000.

R.A. Shelby et al., "*Experimental Verification of a Negative Index of Refraction*", Science, vol. 292, No. 5514, pp. 77-79, Apr. 2001.

Masashi Hotta et al., "*Modal Analysis of Finite-Thickness Slab with Single-Negative Tensor Material Parameters*", IEICE Transactions on Electron, vol. E89-C, No. 9, Sep. 2006.

* cited by examiner

METAMATERIAL PROVIDED WITH AT LEAST ONE SPIRAL CONDUCTOR FOR PROPAGATING ELECTROMAGNETIC WAVE

RELATED APPLICATIONS

This application claims priority under 35 U.S.C. 119 from JAPAN 2011-037115 filed on Feb. 23, 2011 the contents of which are incorporated herein by references.

BACKGROUND OF THE INVENTION

1. Field of the Invention

The present invention relates to a metamaterial, which is an artificial material or medium for propagating an electromagnetic wave, and relates, in particular, to a metamaterial, which functions as an electromagnetic wave propagation medium, and in which only the magnetic permeability of the equivalent dielectric constant and the magnetic permeability of the material or medium becomes negative.

2. Description of the Related Art

Materials having properties that are not existing in the nature can be artificially configured by arraying small pieces of metal, dielectric, magnetic material, a superconductor or the like (unit structure) at intervals sufficiently smaller than the wavelength (equal to or smaller than about one-tenth of the wavelength). The materials are called metamaterials in the sense of materials that belong to a category larger than the category of the material existing in the nature (See, for example, the Patent Documents 1 to 3). The properties of the metamaterials variously change depending on the shape and the material of unit structures and the array of them.

Among others, metamaterials whose equivalent dielectric constant $\in$ and the magnetic permeability $\mu$ simultaneously became negative were named the "Left-Handed Materials (LHM)" since the electric field, the magnetic field and the wave number vector thereof configure the left-handed system. The left-handed materials are referred to as the left-handed metamaterials in the present specification. In contrast to this, the ordinary materials whose equivalent dielectric constant $\in$ and the magnetic permeability $\mu$ simultaneously become positive are called the "Right-Handed Materials (RHM)".

A "negative refractive index material" having a negative refractive index is currently proposed by using the concept of the aforementioned "metamaterial". By using the negative refractive index owned by the negative refractive index material and the properties of an increase in the evanescent wave, the possibility of the achievement of a super lens, whose resolution performance exceeds a diffraction limit which is a physical limit, has been theoretically indicated (See, for example, the Non-Patent Document 1).

Moreover, in order to achieve the negative refractive index material, a "left-handed material" in which the effective dielectric constant and the magnetic permeability both become negative has been proposed. This is an array of wire resonators for making the dielectric constant negative and split ring resonators (SRR) for making the magnetic permeability negative, and its negative refractive index operation is indicated (See, for example, the Non-Patent Document 2).

Prior Art Documents related to the present invention are as follows:

PATENT DOCUMENTS

Patent Document 1: International Publication No. WO2008/038542;

Patent Document 2: Japanese patent laid-open publication No. JP 2008-244683 A; and Patent Document 3: Japanese patent laid-open publication No. JP 2008-252293 A.

NON-PATENT DOCUMENTS

Non-Patent Document 1: J. B. Pendry, "Negative Refraction Makes a Perfect Lens", Physical Review Letters, Vol. 85, No. 18, pp. 3966-3969, October 2000;

Non-Patent Document 2: R. A. Shelby et al., "Experimental Verification of a Negative Index of Refraction", Science, Vol. 292, No. 5514, pp. 77-79, April 2001; and Non-Patent Document 3: Masashi HOTTA et al., "Modal Analysis of Finite-Thickness Slab with Single-Negative Tensor Material Parameters", IEICE Transactions on Electron, Vol. E89-C, No. 9, September 2006.

The aforementioned left-handed materials use both of the wire resonators for making the dielectric constant negative and the split ring resonators (SRR) for simultaneously making the magnetic permeability negative, and a loss due to a current flowing through them becomes large. Moreover, there has been the problem of difficulties in the configuration of a planar circuit (See, for example, the Non-Patent Document 2).

Moreover, it is theoretically indicated that single negative anisotropic materials, whose only dielectric constant or the magnetic permeability is made negative, has a negative refractive index in, for example, the Non-Patent Document 3. However, the fact that the negative refractive index is owned has been theoretically indicated but not experimentally indicated. Moreover, only a configuring method of arraying edge-coupled SRR on a single surface of a substrate is indicated as an implementation method.

Further, utilization for unprecedented high-resolution lithography or signal transmission between circuits and equipment can be considered by using the aforementioned lens. However, the negative refractive index materials, which have been proposed up to now, have had large losses and been unsuitable for circuits. Reduction in the loss of negative refractive index material and an easily feasible configuring method with multi-layered planar circuits that can be produced by the lithography technology are desired.

SUMMARY OF THE INVENTION

An object of the present invention is to solve the aforementioned problems, and provide a metamaterial that is a single negative anisotropic material whose only magnetic permeability is made negative and that is formed in a planar circuit with a loss smaller than that of the prior art.

In order to achieve the aforementioned objective, according to one aspect of the present invention, there is provided a metamaterial including at least one spiral conductor, where only a magnetic permeability selected from among an effective dielectric constant and the magnetic permeability of the metamaterial becomes negative, so that the metamaterial have a negative refractive index characteristic.

In the above-mentioned metamaterial, the material includes a plurality of unit cells arrayed in one of one-dimensional direction, two-dimensional directions, and three-dimensional directions. Each of the unit cell includes a dielectric substrate having first and second surfaces in substantial parallel, and first and second spiral conductors. The first spiral conductor is formed on the first surface of the dielectric substrate. The second spiral conductor is formed in one of a same direction as and an opposite direction to the first spiral conductor, on the second surface of the dielectric substrate, to oppose the first spiral conductor and to be electromagnetically coupled with the first spiral conductor.

According to another aspect of the present invention, there is provided a metamaterial including a pair of split ring conductors, each having a predetermined gap. The pair of split ring conductors is formed to oppose each other and to be electromagnetically coupled. Only a magnetic permeability selected from among an effective dielectric constant and the magnetic permeability of the metamaterial becomes negative, so that the metamaterial has a negative refractive index characteristic.

In the above-mentioned metamaterial, the material includes a plurality of unit cells arrayed in one of one-dimensional direction, two-dimensional directions, and three-dimensional directions. Each of the unit cell includes a dielectric substrate having first and second surfaces in substantial parallel, and first and second split ring conductors. The first split ring conductor is formed on the first surface of the dielectric substrate, and the second split ring conductor is formed on the second surface of the dielectric substrate.

In addition, in the above-mentioned metamaterial, the first and second split ring conductors are formed in one manner of a coupling in a same direction as each other, a coupling in an opposite direction to each other, and an intermediate coupling between the coupling in the same direction as each other and the coupling in the opposite direction to each other.

According to the metamaterial of the present invention, the metamaterial, which is a single negative anisotropic material whose only magnetic permeability is made negative with a loss smaller than that of the prior art, and which can be implemented in a planar circuit. Therefore, when, for example, a negative refractive index lens is configured by using the metamaterial, the resolution performance of the lens can be remarkably improved.

BRIEF DESCRIPTION OF THE DRAWINGS

These and other objects and features of the present invention will become clear from the following description taken in conjunction with the preferred embodiments thereof with reference to the accompanying drawings throughout which like parts are designated by like reference numerals, and in which.

DETAILED DESCRIPTION OF THE PREFERRED EMBODIMENTS

Figure 1:
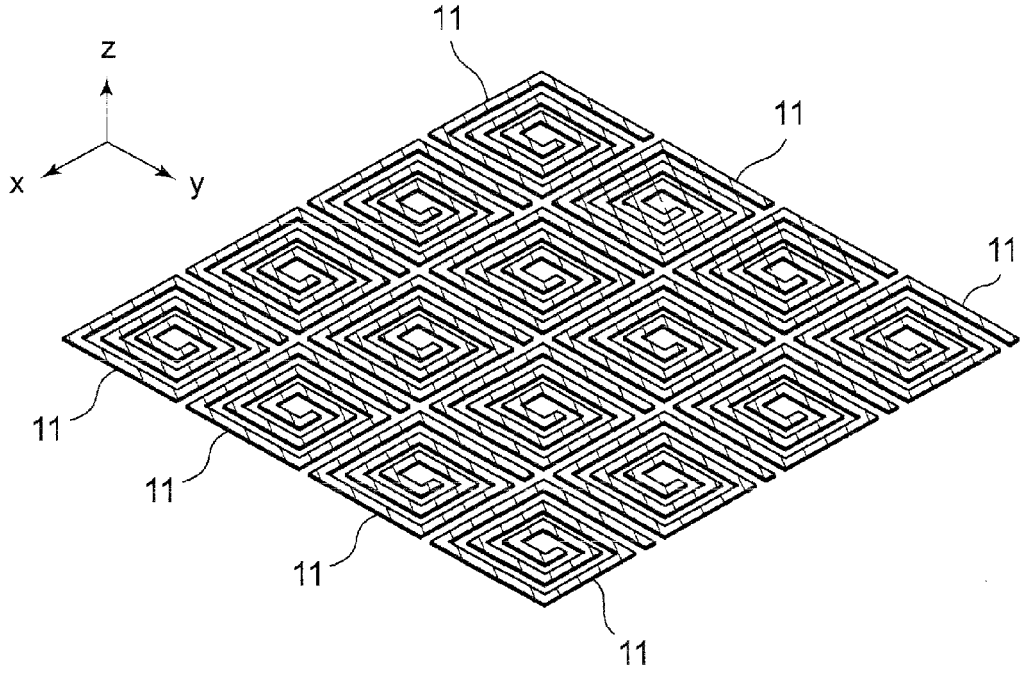
FIG. 1 is a perspective view showing a configuration of a two-dimensional spiral single negative anisotropic material (metamaterial) according to a first preferred embodiment of the present invention.

Preferred embodiments according to the present invention will be described below with reference to the attached drawings. In the preferred embodiments, similar components are denoted by like reference numerals.

First Preferred Embodiment

Figure 2:
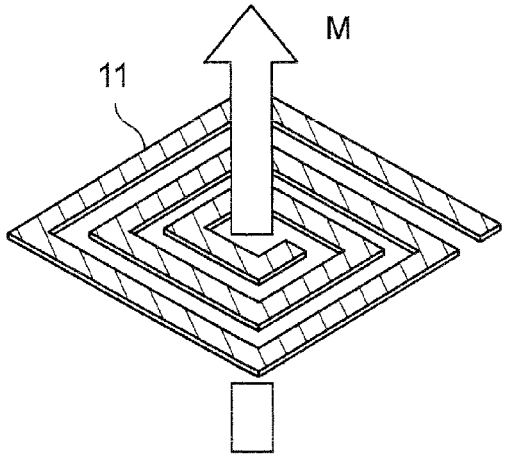
FIG. 2 is a perspective view showing a unit cell of the two-dimensional spiral single negative anisotropic material of FIG. 1.

FIG. 1 is a perspective view showing a configuration of a two-dimensional spiral single negative anisotropic material or medium (metamaterial) according to the first preferred embodiment of the present invention, and FIG. 2 is a perspective view showing a unit cell of the two-dimensional spiral single negative anisotropic material of FIG. 1.

The two-dimensional spiral single negative anisotropic material (metamaterial) of the first preferred embodiment is obtained by using the spiral conductor 11 of FIG. 2 as a unit cell and arraying the same unit cells periodically in a two-dimension manner as shown in FIG. 1. Referring to FIG. 2, the spiral conductor 11 is formed by winding a strip conductor having a predetermined width outwardly from the center so that the external shape becomes a rectangular shape. The spiral conductor 11 has a magnetic moment M due to an induced current with respect to an incident electromagnetic wave having a magnetic field component perpendicular to the plane thereof. Therefore, the material has a uniaxial magnetic anisotropy. This permeability tensor component has Lorentz type dispersion, and there exists a frequency domain in which a negative magnetic permeability appears within the ranges of a resonant frequency $\omega 0$ and a plasma frequency $\omega p$.

Figure 3:
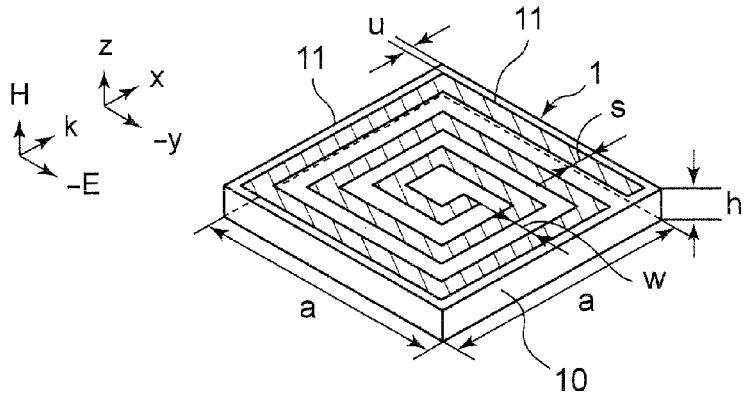
FIG. 3 is a perspective view showing a detailed configuration of a unit cell of FIG. 2.

FIG. 3 is a perspective view showing a detailed configuration of the unit cell 1 of FIG. 2. In order to implement the metamaterial, it is preferable to form a spiral conductor 11 as a conductor pattern on a dielectric substrate 10 and two-dimensionally array the same spiral conductors 11. It is herein assumed that the length of one side of the rectangular shape of the unit cell 1 is "a", the thickness of the dielectric substrate 10 is "h", the relative dielectric constant of the dielectric substrate 10 is $\in_r$, and the line width and the line spacing of the spiral conductor 11 are "s" and "w", respectively. It is noted that "u" is a length from the edge of the unit cell 1 to the outside edge of the spiral conductor 11 located outside.

Figure 4:
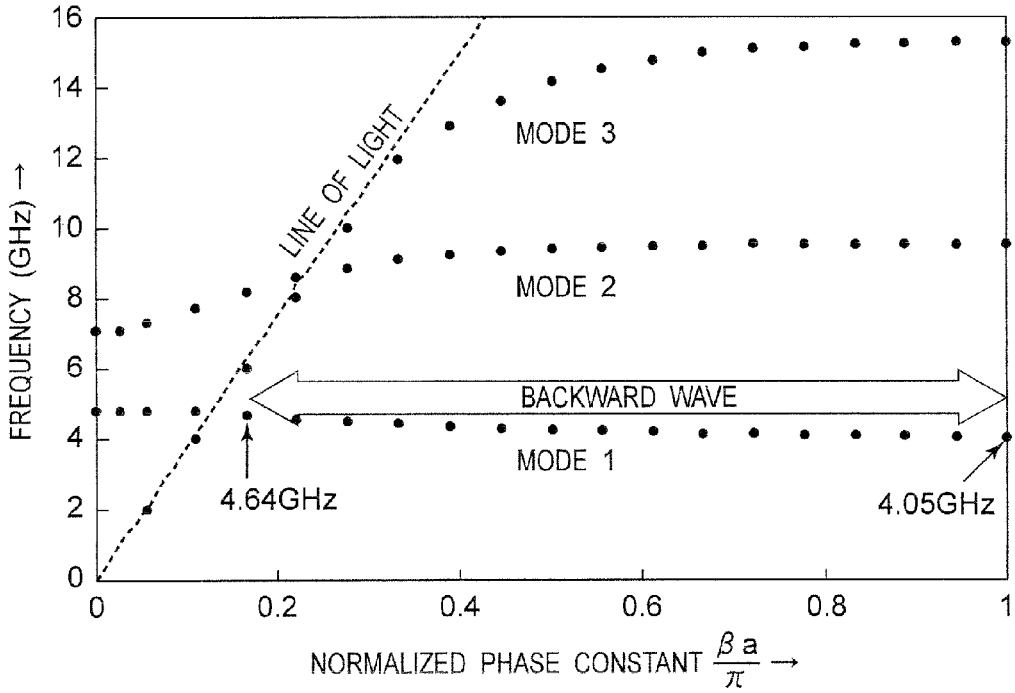
FIG. 4 is a graph showing dispersion characteristics by numerical simulations of the two-dimensional spiral single negative anisotropic material of FIG. 1.

FIG. 4 is a graph showing dispersion characteristics by numerical simulations of the two-dimensional spiral single negative anisotropic material of FIG. 1. The present inventor and others obtained the dispersion characteristics of electromagnetic wave propagating in the material of the present preferred embodiment by electromagnetic field simulations based on the finite element method. According to the numerical calculations, unit cells of the spiral conductor 11 that is made of copper and has a line width s=0.3 mm and a line spacing w=0.3 mm as shown in FIG. 3 are assumed to be periodically arrayed in infinite periods with a lattice constant a=4 mm on a dielectric substrate 10 that is made of PTFE (polytetrafluoroethylene) and has a relative dielectric constant $\in_r$=2.17, a thickness h=0.508 mm and a dielectric loss=0.00085. As apparent from FIG. 4, it could be confirmed that a propagation mode (Mode 1) of a backward wave of different phase velocities and group velocities existed in the bands of 4.05 to 4.64 GHz. The frequency band in this case is 592.9 MHz, and the fractional bandwidth (ratio of the bandwidth with respect to the average frequency of the band of 4.05 to 4.64 GHz) is 13.6%.

Figure 5:
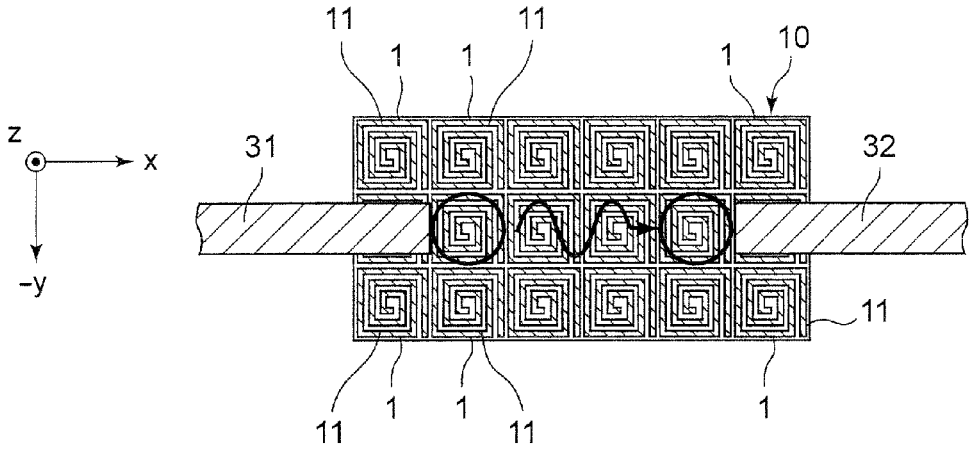
FIG. 5 is a plan view showing an experimental system for measuring transmission characteristics and reflection characteristics of the two-dimensional spiral single negative anisotropic material of FIG. 1.
Figure 6:
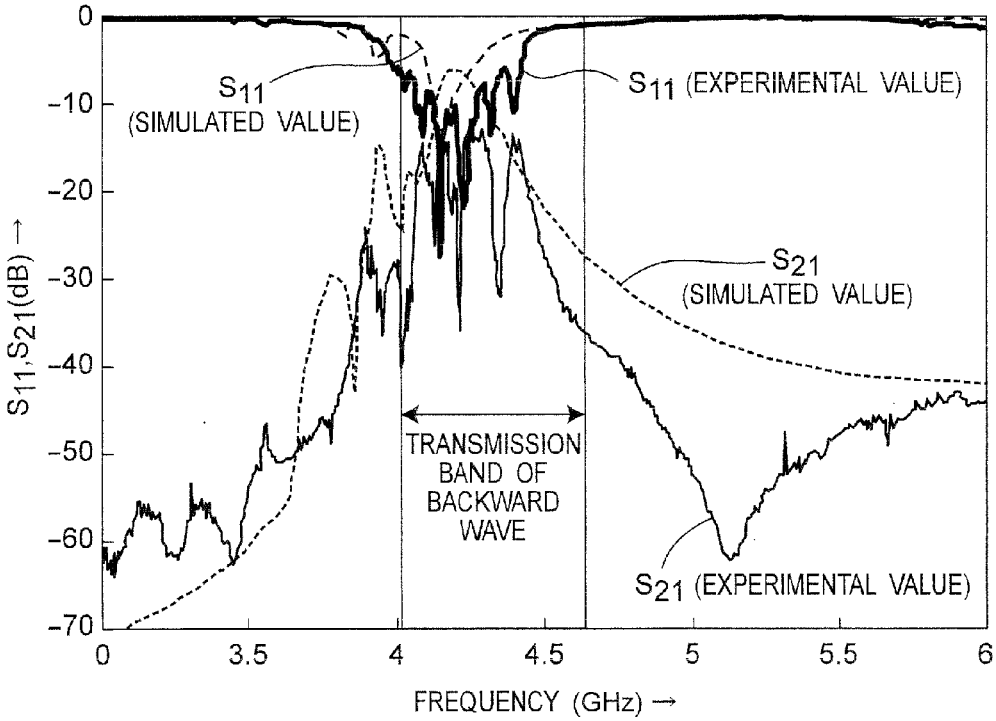
FIG. 6 is a graph showing frequency characteristics of a reflection coefficient S11 and a transmission coefficient S21, which are results of measurements and numerical simulations using the experimental system of FIG. 5.

FIG. 5 is a plan view showing an experimental system for measuring transmission characteristics and reflection characteristics of the two-dimensional spiral single negative anisotropic material of FIG. 1, and FIG. 6 is a graph showing frequency characteristics of a reflection coefficient S11 and a transmission coefficient S21, which are results of measurements and numerical simulations obtained by the experimental system of FIG. 5.

The present inventor made a prototype having such a structure that the unit cells 1 having the structure used in the numerical calculations are arrayed in a form of 12×12 cells, and obtained the transmission characteristics and the reflection characteristics to an in-plane propagation wave in the material by means of two magnetic loop probes 31 and 32 as shown in FIG. 5. The magnetic loop probes 31 and 32 were arranged with the loop plane parallel to the plane of the spiral conductor 11 so that magnetic fluxes penetrating the loop are electromagnetically coupled with the magnetic moment owned by the spiral. The transmission coefficient S21 and the reflection coefficient S11 between the two magnetic loop probes 31 and 32, which were placed in a plane located at a distance 3 mm above the surface of the material with a distance of 12 mm between the loop probes 31 and 32, were measured by a vector network analyzer. FIG. 6 additionally shows calculation results of the transmission characteristics and the reflection characteristics obtained by the numerical simulations of the structure in which the 3×6 identical unit cells 1 are arrayed. FIG. 6 shows a propagation band of the backward wave which is obtained from the numerical simulations of the dispersion characteristics.

As apparent from FIG. 6, it could be confirmed that the pass-band obtained by the measurements and the propagation band of the backward wave by the numerical simulations of the dispersion characteristics coincided with each other to a certain degree. Moreover, the pass-band almost coincided with the propagation band by the numerical simulations to the finite number structure.

Figure 7:
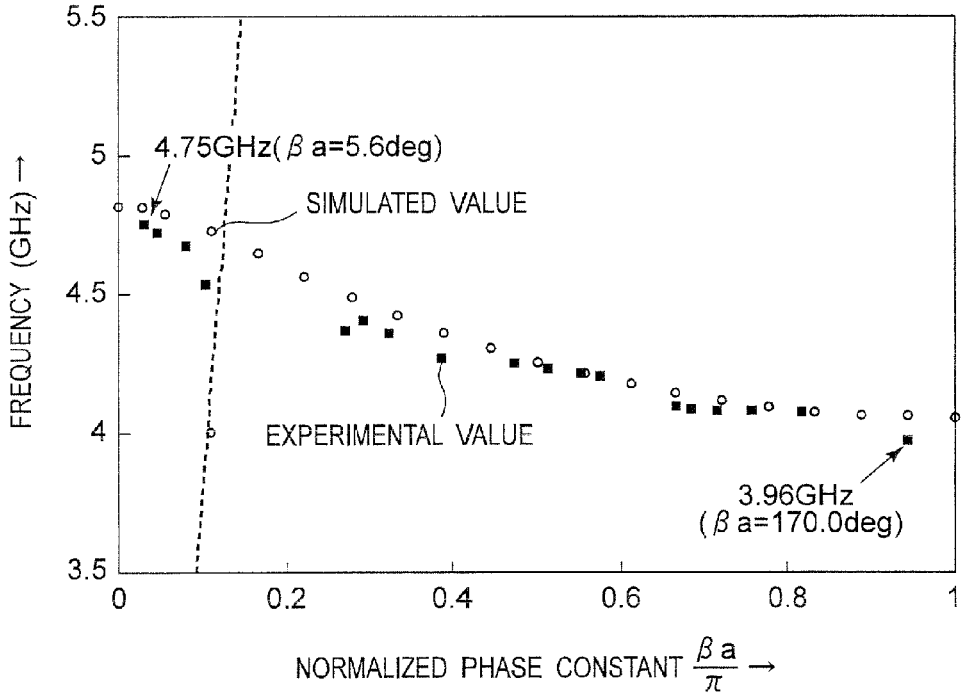
FIG. 7 is a graph showing dispersion characteristics, which are results of measurements and numerical simulations of the two-dimensional spiral single negative anisotropic material of FIG. 1.

FIG. 7 is a graph showing dispersion characteristics, which are results of measurements and numerical simulations of the two-dimensional spiral single negative anisotropic material of FIG. 1. The present inventor examined the relation between the inter-probe distance and the port by means of an automatic stage. FIG. 7 shows measurement results of changes in the phase shift amount with respect to a movement distance in the x-axis direction. FIG. 7 additionally shows the dispersion characteristics obtained by numerical simulations.

As apparent from FIG. 7, a propagation region exists between 3.96 to 4.75 GHz according to the dispersion curve obtained by the measurements, and this frequency band coincided well with the left-handed system propagation band by the numerical simulations. Moreover, such properties of the backward wave propagation that the wave number decreases with an increase in the frequency can be confirmed in this propagation region, and it can be understood that the negative refractive index characteristic of the present material can be experimentally confirmed.

As described above, according to the present preferred embodiment, the prototype of the two-dimensional spiral single negative anisotropic material was made, and it was experimentally confirmed that the present material had a negative refractive index characteristic. The two-dimensional spiral single negative anisotropic material of the present preferred embodiment, which is formed in a planar shape, is therefore compact and light weight and has a transmission loss lower than that of the prior art. Moreover, the spiral resonator, which uses the spiral conductor 11 and is able to lower the resonance frequency by winding long the spiral length, is therefore effective for the size reduction of the unit cell. The resolution performance upon configuring the negative refractive index lens cannot be made to be equal to or smaller than the size of the unit cell, and therefore, this is useful for an improvement in the resolution performance.

Second and Third Preferred Embodiments

Figure 8:
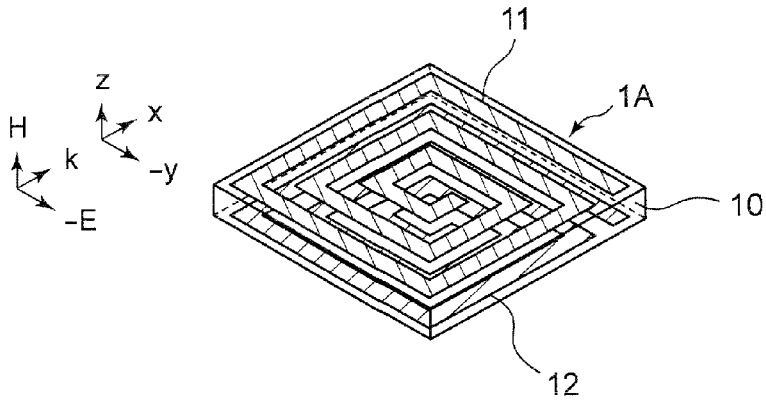
FIG. 8 is a perspective view showing a configuration of a unit cell of a two-dimensional spiral single negative anisotropic material (metamaterial) according to a second preferred embodiment of the present invention.
Figure 9:
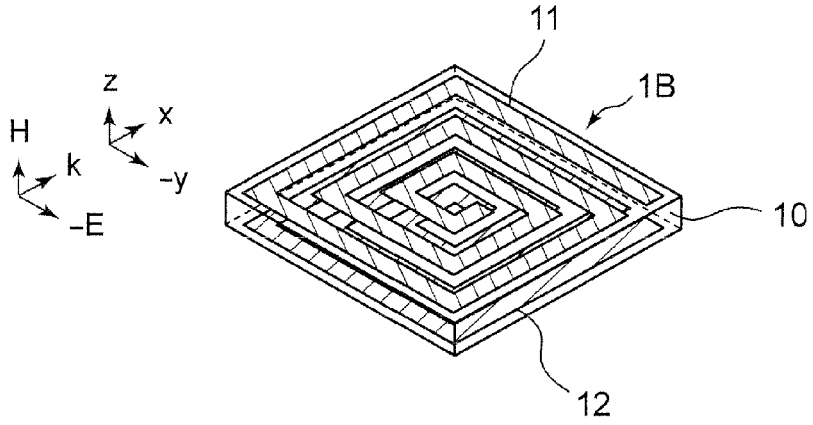
FIG. 9 is a perspective view showing a configuration of a unit cell of a two-dimensional spiral single negative anisotropic material (metamaterial) according to a third preferred embodiment of the present invention.

FIG. 8 is a perspective view showing a configuration of a unit cell of a two-dimensional spiral single negative anisotropic material (metamaterial) according to the second preferred embodiment of the present invention. FIG. 9 is a perspective view showing a configuration of the unit cell of a two-dimensional spiral single negative anisotropic material (metamaterial) according to the third preferred embodiment of the present invention.

The unit cell 1A of FIG. 8 is configured by forming a spiral conductor 11 on the top surface of a dielectric substrate 10, and by forming a spiral conductor 12, which is wound in the same direction as that of the spiral conductor 11 and has the same specifications as those of the spiral conductor 11, and which is formed to oppose the spiral conductor 11 on the bottom surface of a dielectric substrate 10 (being in substantial parallel to the top surface of the dielectric substrate 10) and to be electromagnetically coupled with the spiral conductor 11, namely so that the spiral conductors 11 and 12 are electromagnetically coupled with each other. This is referred to as a same direction type unit cell 1A.

The unit cell 1B of FIG. 9 is configured by forming a spiral conductor 11 on the top surface of a dielectric substrate 10, and forming a spiral conductor 12, which is wound in a direction opposite to that of the spiral conductor 11 and has the same specifications as those of the spiral conductor 11, and which is formed to oppose the spiral conductor 11 on the bottom surface of a dielectric substrate 10 and to be electromagnetically coupled with the spiral conductor 11, namely, so that the spiral conductors 11 and 12 are electromagnetically coupled with each other. This is referred to as an opposite direction type unit cell 1B.

Figure 10:
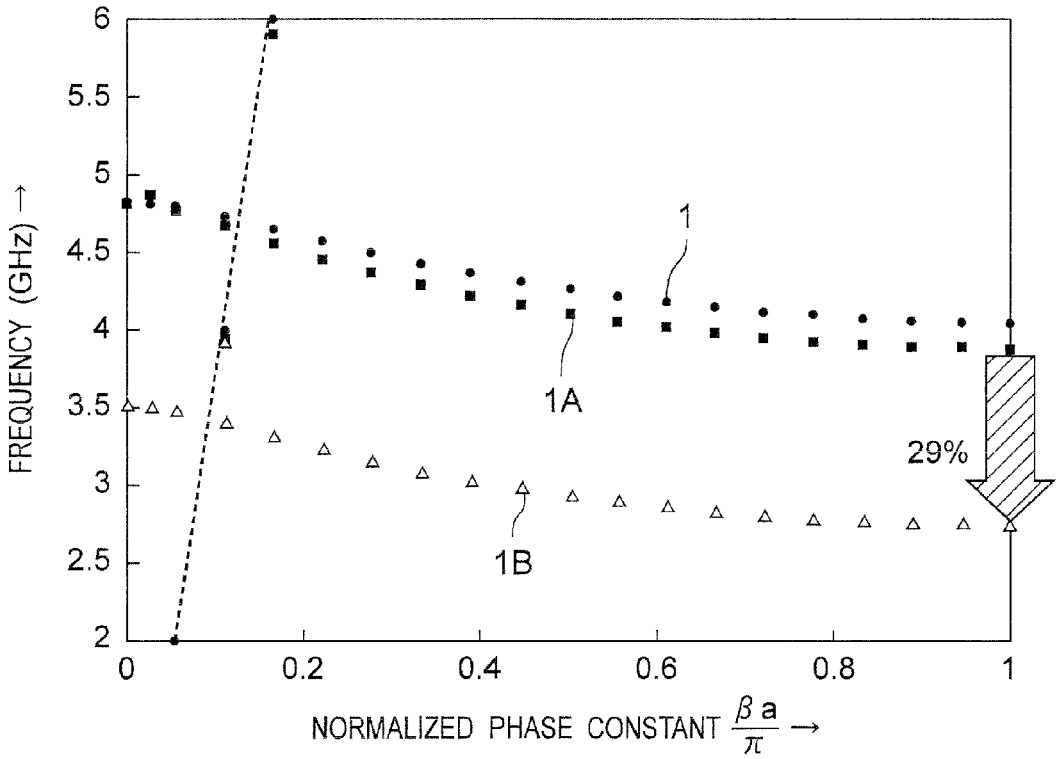
FIG. 10 is a graph showing dispersion characteristics, which are results of numerical simulations of the two-dimensional spiral single negative anisotropic material (metamaterial) using the unit cells of FIGS. 2, 8 and 9.

FIG. 10 is a graph showing dispersion characteristics, which are results of numerically simulating a two-dimensional spiral single negative anisotropic material (metamaterial) in which the unit cells 1, 1A and 1B of FIGS. 2, 8 and 9 are periodically arrayed in infinite periods, in a manner similar to that of FIG. 7. As apparent from FIG. 10, in contrast to the fact that the fractional bandwidth is 16.0% in the band of 3.8 to 4.6 GHz in the case of the material using the unit cell 1 as configured to include one spiral conductor 11 and the same direction type unit cell 1A, the material using the opposite direction coupled type unit cell 1B has a fractional bandwidth of 18.7% in the band of 2.8 to 3.3 GHz. That is, the multilayering in the opposite direction leads to such advantageous effects that the magnetic moment can be enlarged, the bandwidth can be increased, the operating frequency can be also remarkably lowered, and a remarkable size reduction can be achieved with the unit cells of the same size.

Fourth Preferred Embodiment

Figure 11:
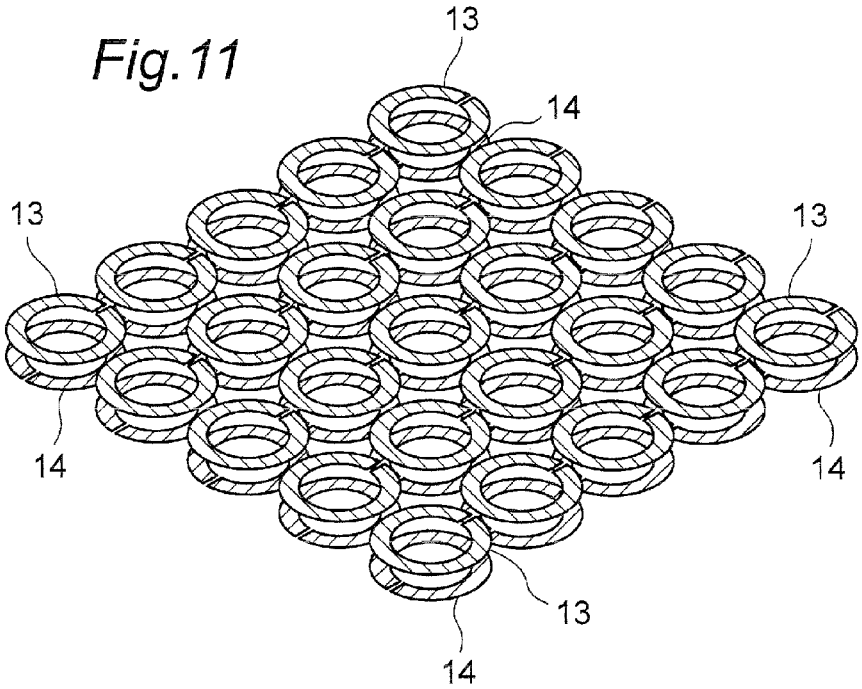
FIG. 11 is a perspective view showing a configuration of a two-dimensional spiral single negative anisotropic material (metamaterial) according to a fourth preferred embodiment of the present invention.
Figure 12:
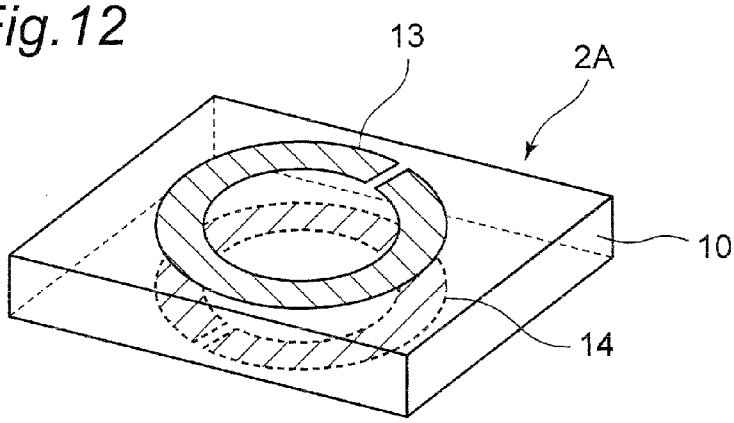
FIG. 12 is a perspective view showing a detailed configuration of a unit cell of FIG. 11.

FIG. 11 is a perspective view showing a configuration of a two-dimensional spiral single negative anisotropic material (metamaterial) according to the fourth preferred embodiment of the present invention, and FIG. 12 is a perspective view showing a detailed configuration of a unit cell 2A of FIG. 11.

Referring to FIG. 12, the unit cell 2A of the two-dimensional spiral single negative anisotropic material (metamaterial) of the fourth preferred embodiment is configured by forming an annular split ring conductor 13 having a predetermined gap on the top surface of a dielectric substrate 10, and by forming an annular split ring conductor 14 on the bottom surface of dielectric substrate 10 to oppose the annular split ring conductor 13 and to be electromagnetically coupled with the annular split ring conductor 13, namely, so that the annular split ring conductors 13 and 14 are electromagnetically coupled with each other. In this case, the annular split ring conductor 14 has the same specifications as those of the split ring conductor 13, and has a predetermined gap which is formed to be alternately staggered by 180 degrees with respect to the split ring conductor 13. This is referred to as an opposite direction coupled type unit cell 2A. As described above, the split ring conductors 13 and 14 are coupled with each other in the vertical direction or top and bottom, and this leads to that broadside coupling can be achieved in a band wider than that of edge coupling of arraying in the transverse direction, and the array density can be increased. The material of FIG. 11 is characterized by arraying the opposite direction coupled type unit cells 2A periodically in two-dimensional directions.

Figure 13:
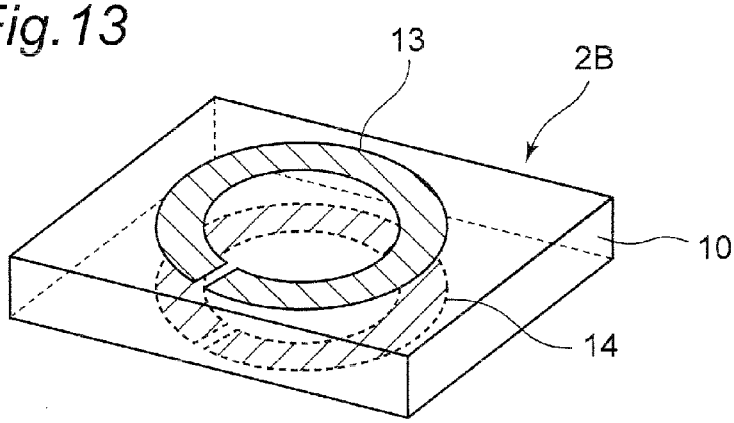
FIG. 13 is a perspective view showing a detailed configuration of a modified preferred embodiment of a unit cell of FIG. 11.

FIG. 13 is a perspective view showing a detailed configuration of a modified preferred embodiment of the unit cell of FIG. 11. The unit cell 2B of FIG. 13 is configured by forming an annular split ring conductor 13 on the top surface of a dielectric substrate 10, and by forming an annular split ring conductor 14 on the bottom surface of the dielectric substrate 10 to oppose the same annular split ring conductor 14 so as to be electromagnetically coupled with the annular split ring conductor 14, namely, so that the annular split ring conductors 13 and 14 are electromagnetically coupled with each other. In this case, the annular split ring conductor 14 has the same specifications as those of the split ring conductor 13, and has a gap having a gap position vertically coinciding with that of the split ring conductor 13. This is referred to as a same direction coupled type unit cell 2B.

Figure 14:
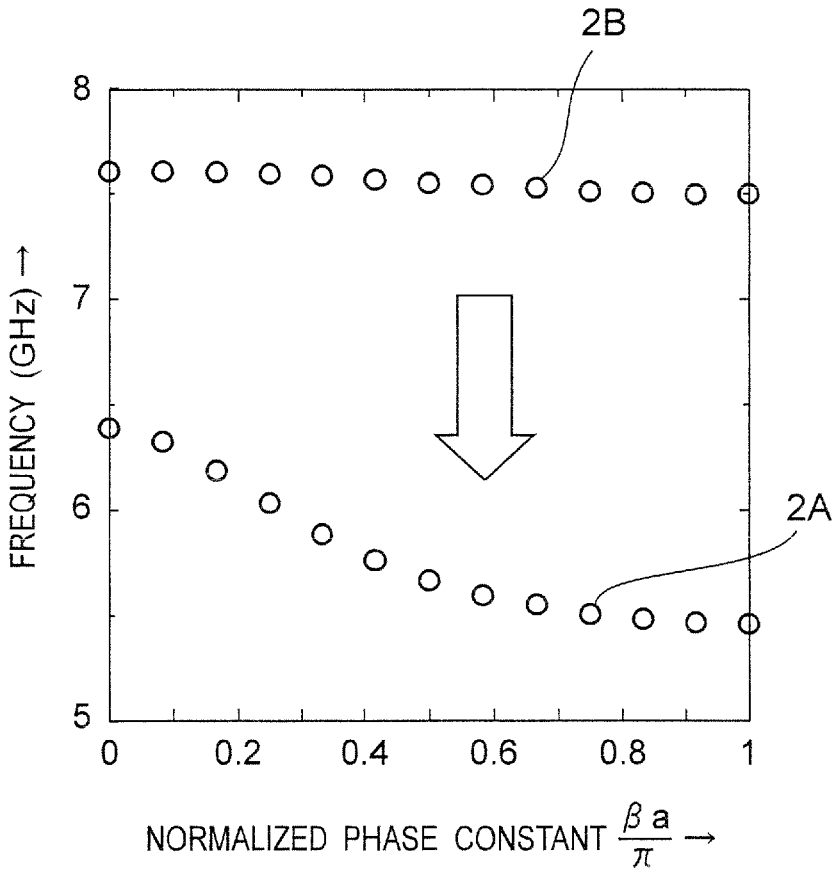
FIG. 14 is a graph showing dispersion characteristics, which are results of numerical simulations of the two-dimensional spiral single negative anisotropic material (metamaterial) using the unit cells of FIGS. 12 and 13.

FIG. 14 is a graph showing dispersion characteristics, which are results of numerical simulations of the two-dimensional spiral single negative anisotropic material (metamaterial) using the unit cells of FIGS. 12 and 13. It is noted that each of the split ring conductors 13 and 14 have a radius of 2.4 mm, a width of 0.8 mm and a gap of 200 μm, and the other specifications are similar to those of FIG. 10. As apparent from FIG. 14, the following facts can be found out.

(a) A negative refractive index characteristic could be confirmed if whichever of the unit cells 2A and 2B was used.

(b) When the opposite direction coupled type unit cell 2A is used, the operating frequency can be reduced to about 75% or less, and this allows the size reduction to be achieved in the case of implementation in the same size.

(c) The operation in a wide band can be achieved if whichever of the unit cells 2A and 2B is used. This is because the frequency range of the negative magnetic permeability is increased by a strong magnetic resonance.

Novelty and Features of the Invention Including Present Preferred Embodiments The novelty and the features of the present invention including the present preferred embodiments are as follows.

(a) Although the single negative anisotropic material had conventionally been expected only theoretically, according to the present invention, the concrete implementation techniques of the metamaterial first proposed by numerical simulations and experiments.

(b) The double negative metamaterial, which also needs a structure of a negative dielectric constant, leads to a conductor loss due to a metal mesh and the like because of the consequent more complicated (three-dimensional) structure. However, the single negative anisotropic material is able to reduce the loss as described above. According to the numerical calculations by the present inventor, the Q value was improved by 134% to 150% in the 20-GHz band.

(c) The material, which has a simple configuration of the spiral conductors 11 and 12 or the split ring conductors 13 and 14 and is able to be implemented with a planar circuit, can be extremely easily applied to semiconductor processes.

Modified Preferred Embodiments

The spiral conductors 11 and 12 are formed in the square shapes in the first to third preferred embodiments. However, the present invention is not limited to this, and each of the spiral conductors 11 and 12 may be formed in a rectangular shape, a polygonal shape, an annular shape, an elliptic shape or the like with regard to their external shapes.

The split ring conductors 13 and 14 are formed in the annular shapes in the fourth preferred embodiment. However, the present invention is not limited to this, and each of the split ring conductors 13 and 14 may be formed in a rectangular shape, a polygonal shape, an elliptic shape or the like with regard to their external shapes.

The coupling in the opposite direction is configured by arranging the split ring conductors 13 and 14 so that the gap positions are located to be shifted by 180 degrees and to oppose each other, in the unit cell 2A of the fourth preferred embodiment. On the other hand, the coupling in the same direction is configured by arraying the split ring conductors 13 and 14 so that the gap positions are located in the zero-degree position coinciding with each other. However, the present invention is not limited to this, and it is acceptable to arrange the gap positions in a position exceeding zero degrees and smaller than 180 degrees so that the split ring conductors 13 and 14 are coupled with each other by an intermediate coupling between the coupling in the opposite direction and the coupling in the same direction.

Figure 15:
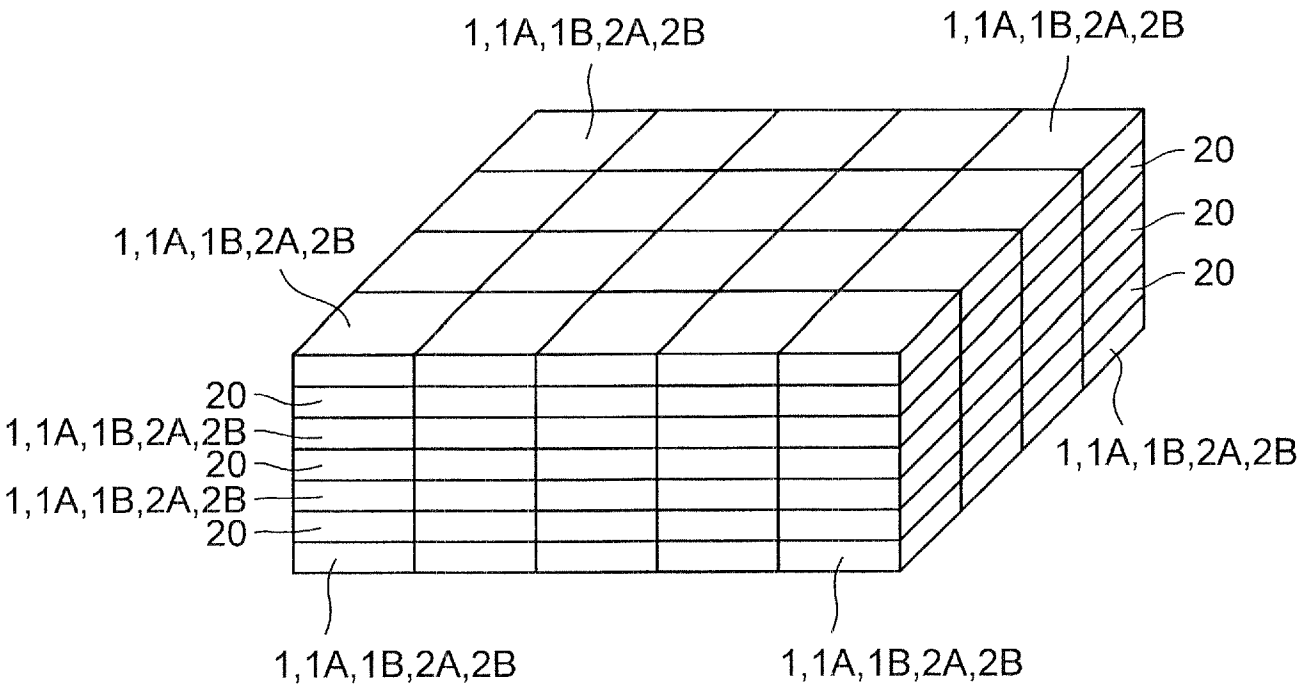
FIG. 15 is a perspective view showing a configuration of a metamaterial when the unit cells of the two-dimensional spiral single negative anisotropic materials (metamaterials) of the first to fourth preferred embodiments are implemented in three dimensions.

FIG. 15 is a perspective view showing a configuration of a metamaterial when the unit cells 1, 1A, 1B, 2A and 2B of the two-dimensional spiral single negative anisotropic material (metamaterial) of the first to fourth preferred embodiments are implemented three-dimensionally. It is characterized in that the unit cells 1, 1A, 1B, 2A and 2B are three-dimensional arrayed in a multi-layered form to provide the dielectric layers 20 therebetween, where the dielectric layers 20 have a predetermined thickness in the vertical direction. In this case, the unit cells 1, 1A, 1B, 2A and 2B are electromagnetically coupled together in the vertical direction (thickness direction of the dielectric substrates 10 and 20). It is noted that the dielectric layer 20 may be eliminated in the case of the unit cell 1. In this case, the array of the unit cells may be either one-dimensional array or a two-dimensional array. Further, the unit cells 1, 1A, 1B, 2A and 2B are periodically arrayed in the aforementioned preferred embodiments. However, the present invention is not limited to this, and the unit cells may be arrayed non-periodically.

INDUSTRIAL APPLICABILITY

As mentioned above in details, according to the metamaterial of the present invention, the metamaterial, which is a single negative anisotropic material whose only magnetic permeability is made negative with a loss smaller than that of the prior art, and which can be implemented in a planar circuit. Therefore, when, for example, a negative refractive index lens is configured by using the metamaterial, the resolution performance of the lens can be remarkably improved.

Therefore, when the metamaterial of the invention is configured as a one-dimensional line to transmit a backward wave, it can be applied to a phase shifter, an omni-directional radiation leakage antenna or the like. Moreover, when the metamaterial of the present invention is configured as a two-dimensional material or medium, it can be applied to a negative refractive index lens, a super-lens, a lens antenna or the like.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A metamaterial comprising a plurality of unit cells arrayed in one of one-dimensional direction, two-dimensional directions, and three-dimensional directions, each of the unit cells including:

a dielectric substrate having first and second surfaces arranged in a substantially parallel relationship;

a first spiral conductor formed on the first surface of the dielectric substrate; and a second spiral conductor formed on the second surface of the dielectric substrate, wherein the second spiral conductor is formed in one of a same direction as and an opposite direction to the first spiral conductor so as to oppose the first spiral conductor and to be electromagnetically coupled with the first spiral conductor, and wherein only one of an effective dielectric constant and a magnetic permeability of the metamaterial becomes negative, so that the metamaterial has a negative refractive index characteristic.

2. The metamaterial as claimed in claim 1, wherein the second spiral conductor is formed in the same direction as the first spiral conductor.

3. The metamaterial as claimed in claim 1, wherein the second spiral conductor is formed in the opposite direction to the first spiral conductor.

* * * * *